United States Patent [19]

Behar

[11] Patent Number: 4,499,999

[45] Date of Patent: Feb. 19, 1985

[54] PICNIC BASKET

[76] Inventor: Marvin L. Behar, 316 Main St., Edmonds, Wash. 98020

[21] Appl. No.: 505,990

[22] Filed: Jun. 30, 1983

[51] Int. Cl.[3] ..... A45C 11/20; A45C 9/00; B65D 81/36

[52] U.S. Cl. ..... 206/546; 206/541; 206/549

[58] Field of Search ..... 206/541, 546, 549

[56] References Cited

U.S. PATENT DOCUMENTS 3,097,782 7/1963 Koropatkin et al. ..... 206/546
4,337,812 7/1982 Trinkner ..... 206/541

*Primary Examiner*—William T. Dixson, Jr.
*Attorney, Agent, or Firm*—Thomas W. Secrest

[57] ABSTRACT

This invention is directed to an article which can be used as a basket for carrying items such as food and drink on a picnic and also used for carrying cloths and shoes and at the picnic can be spread out or stretched out and used as a tablecloth or a picnic cloth.

30 Claims, 17 Drawing Figures

PICNIC BASKET

CROSS-REFERENCE TO RELATED APPLICATIONS

In conjunction with the filing of this patent application I am filing two U.S. design patent applications entitled PICNIC BASKET, and which patent applications bear the filing date of June 20, 1983, and Ser. Nos. 506,060 and 506,061.

THE BACKGROUND OF THE INVENTION

People like to go on picnics and on outings. They like to have some food and drink along for the picnic or the outing. Generally, in order to carry the food and drink it is necessary to have a basket. Also, if the people are sitting on the grass or at a table it is desirable to have a separate material for spreading on the grass or ground or on the table. Generally, people will have a tablecloth, a sheet of plastic or newspapers for spreading on the table or on the grass.

To carry the sheet of plastic, the tablecloth or the newspaper requires the carrying of a separate item. It is easy to mislay the separate item or to lose the separate item.

Therefore, the carrying of a picnic basket and also the carring of a table cloth can present some minor problems.

This invention is directed to an apparatus which can function both as a basket for carrying food and drink and also can function as a tablecloth.

This invention comprises a flexible limber material with attaching means. It can be folded to form a basket. There can be placed in the basket food and drink. Then, when the individual or individuals reach the desired destination the food and drink can be taken from the basket and the attaching means disassociated so that the flexible, limber material can be spread on the ground or on a table and be used as a tablecloth.

There are straps on the flexible limber material to be grasped and held by an individual to assist in carrying the basket, the food and the drink.

THE DRAWINGS

In the drawings it is seen that:

Figure 2:
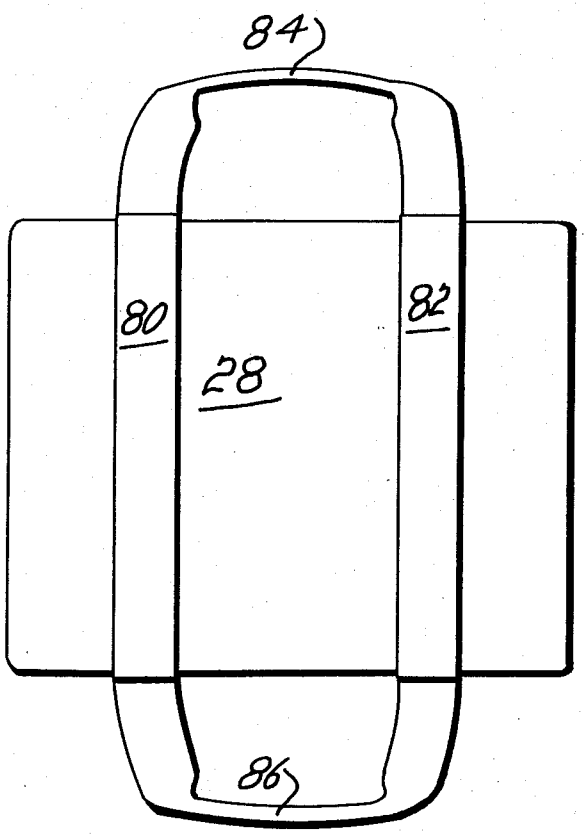
FIG. 2 is a bottom plan view of the invention in the configuration of a basket.
Figure 1:
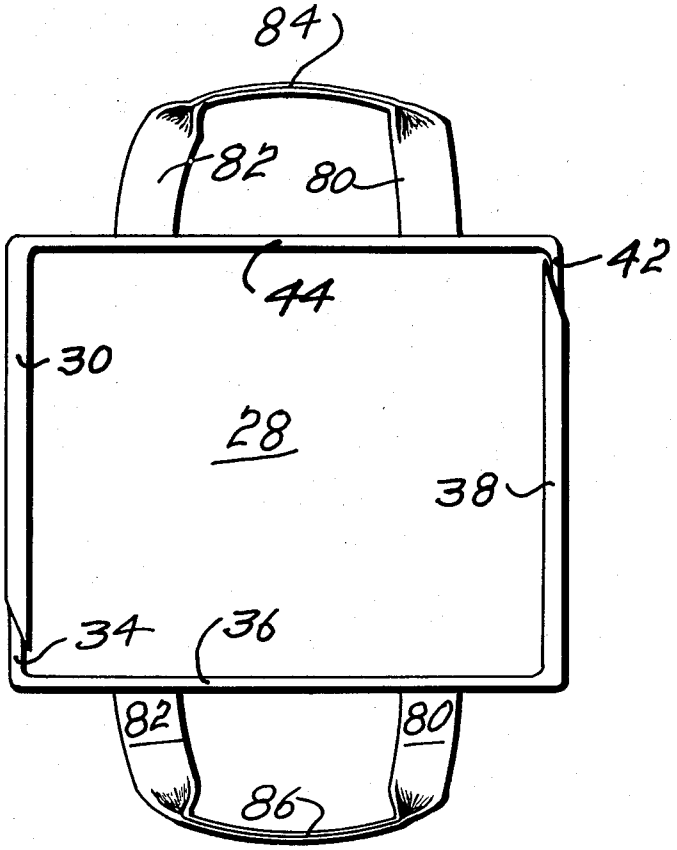
FIG. 1 is a top plan view of the invention in the configuration of a basket.
Figure 4:
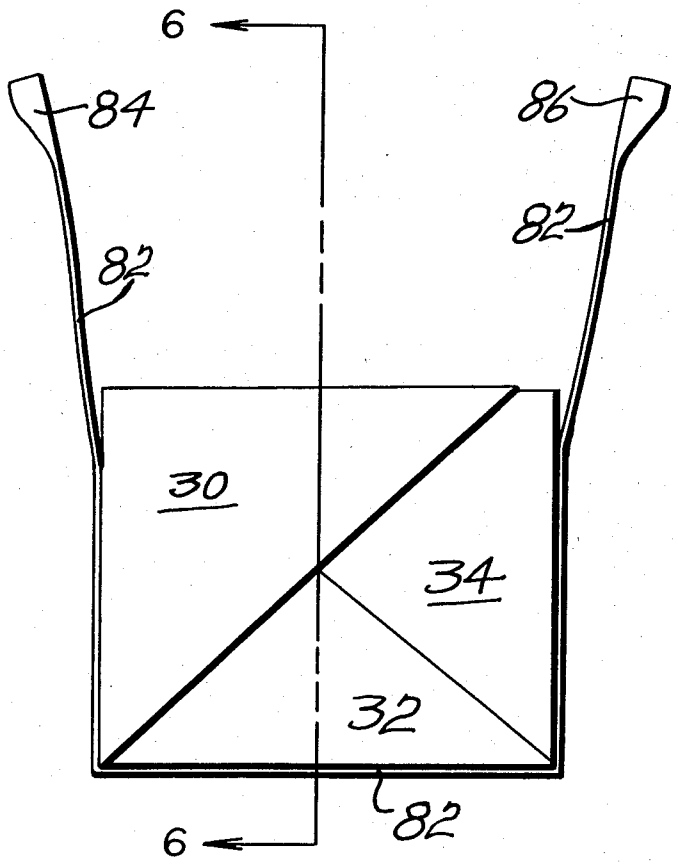
FIG. 4 is an end elevational view of the invention in the configuration of a basket.
Figure 3:
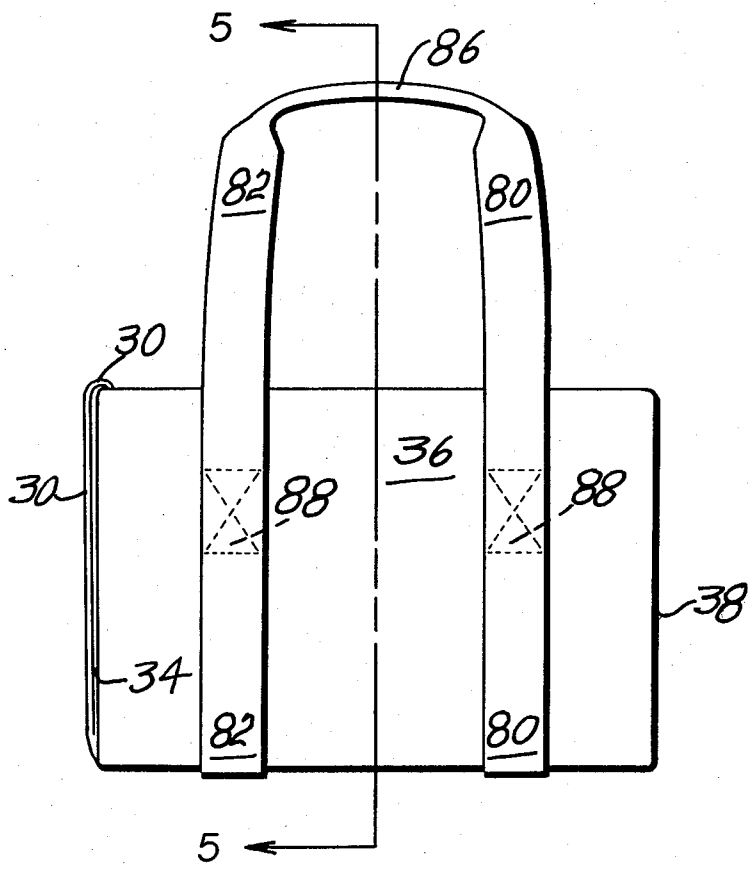
FIG. 3 is a side elevational view of the invention in the configuration of a basket.
Figure 5:
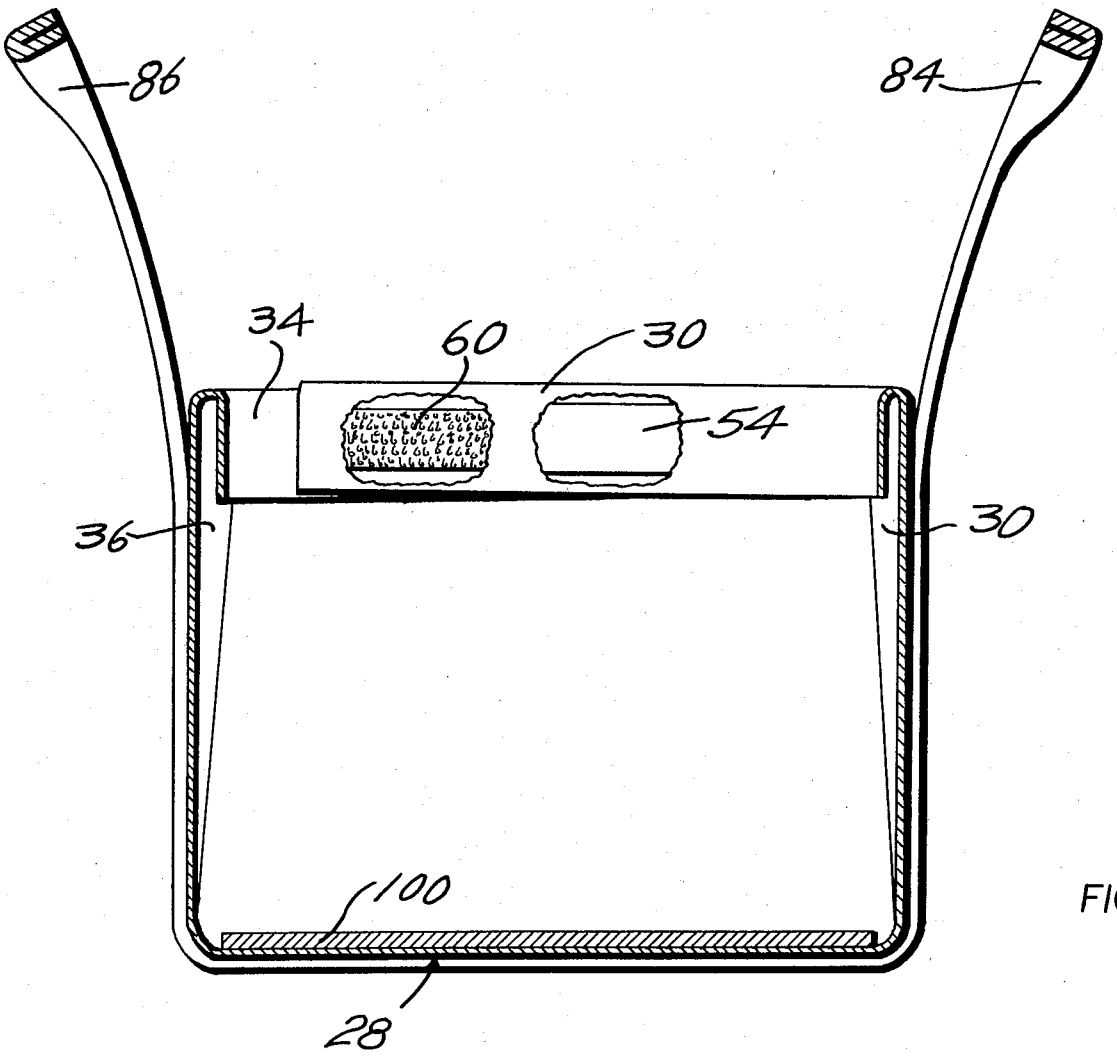
FIG. 5 is a vertical cross sectional view from the first end to the second end of the invention in the configuration of a basket and illustrates the attaching means connecting together the flexible, limber material to make a basket.
Figure 6:
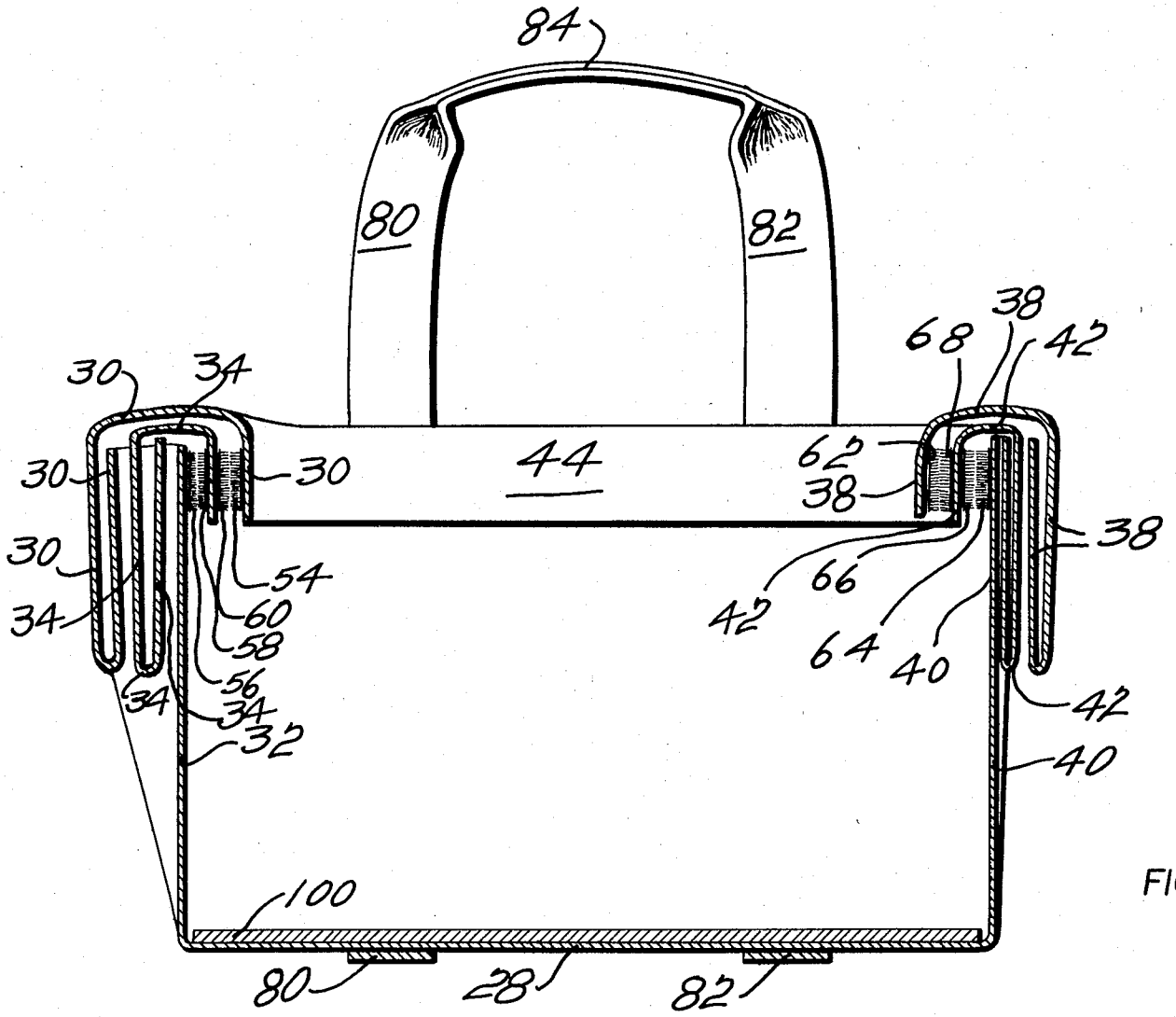
FIG. 6 is a vertical cross sectional view of the invention in the configuration of a basket and taken from one side to the other side.
Figure 12:
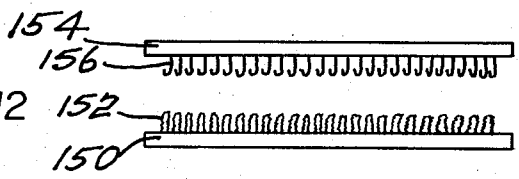
Figure 11:
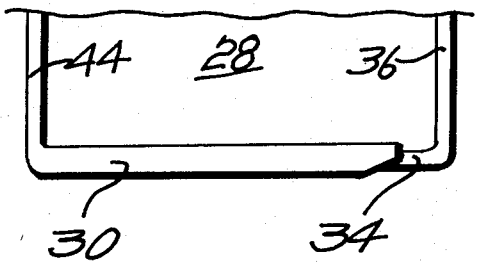
FIG. 11 is a fragmentary top plan view illustrating the panels being folded over to form one end of the basket.
Figure 10:
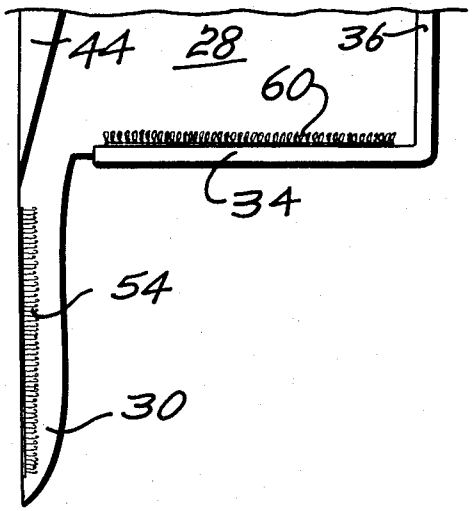
FIG. 10 is a fragmentary top plan view illustrating the panels in a partially folded state to form the basket.
Figure 9:
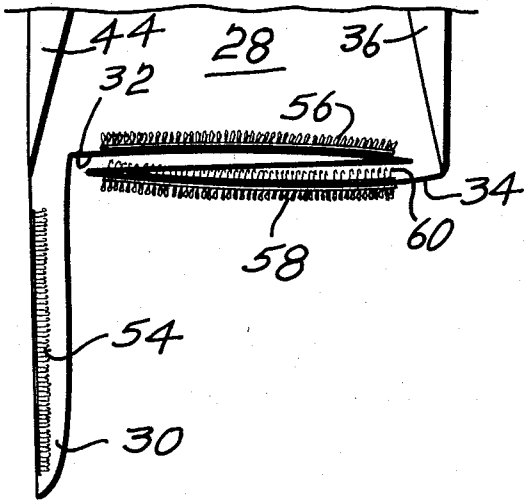
FIG. 9 is a fragmentary top pan view illustrating the various panels prior to the panels being folded over in the initial step in forming a basket.
Figure 14:
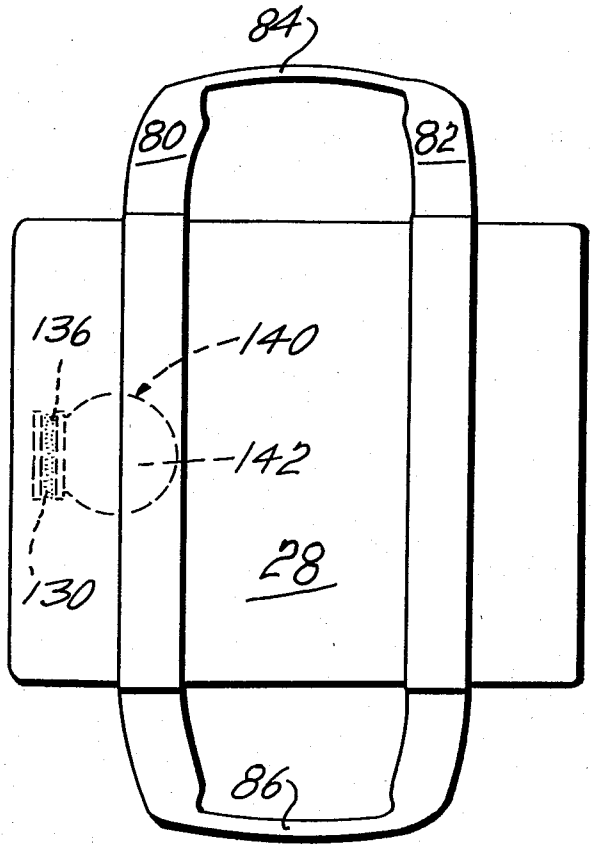
Figure 13:
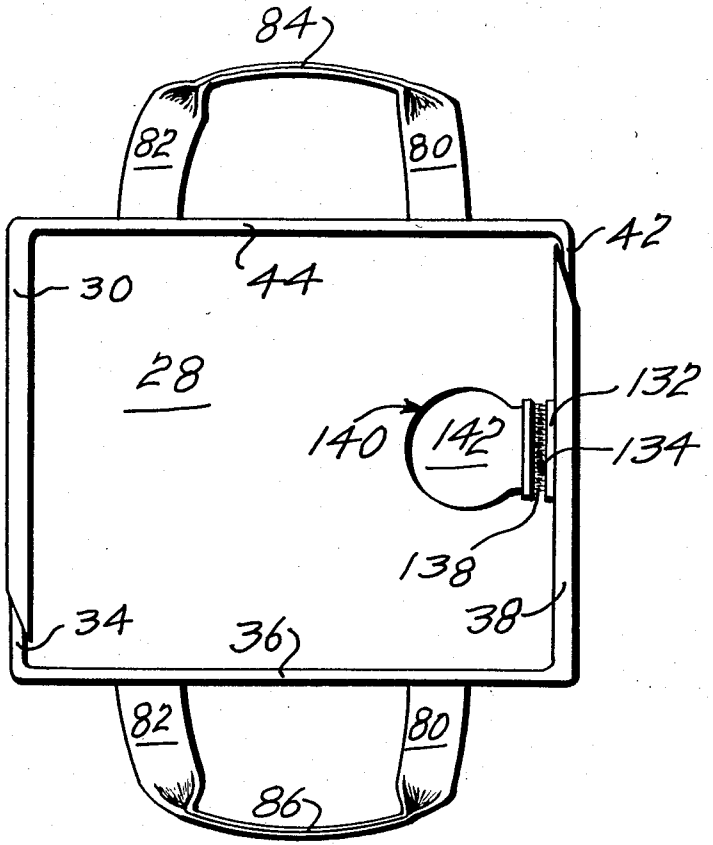
Figure 15:
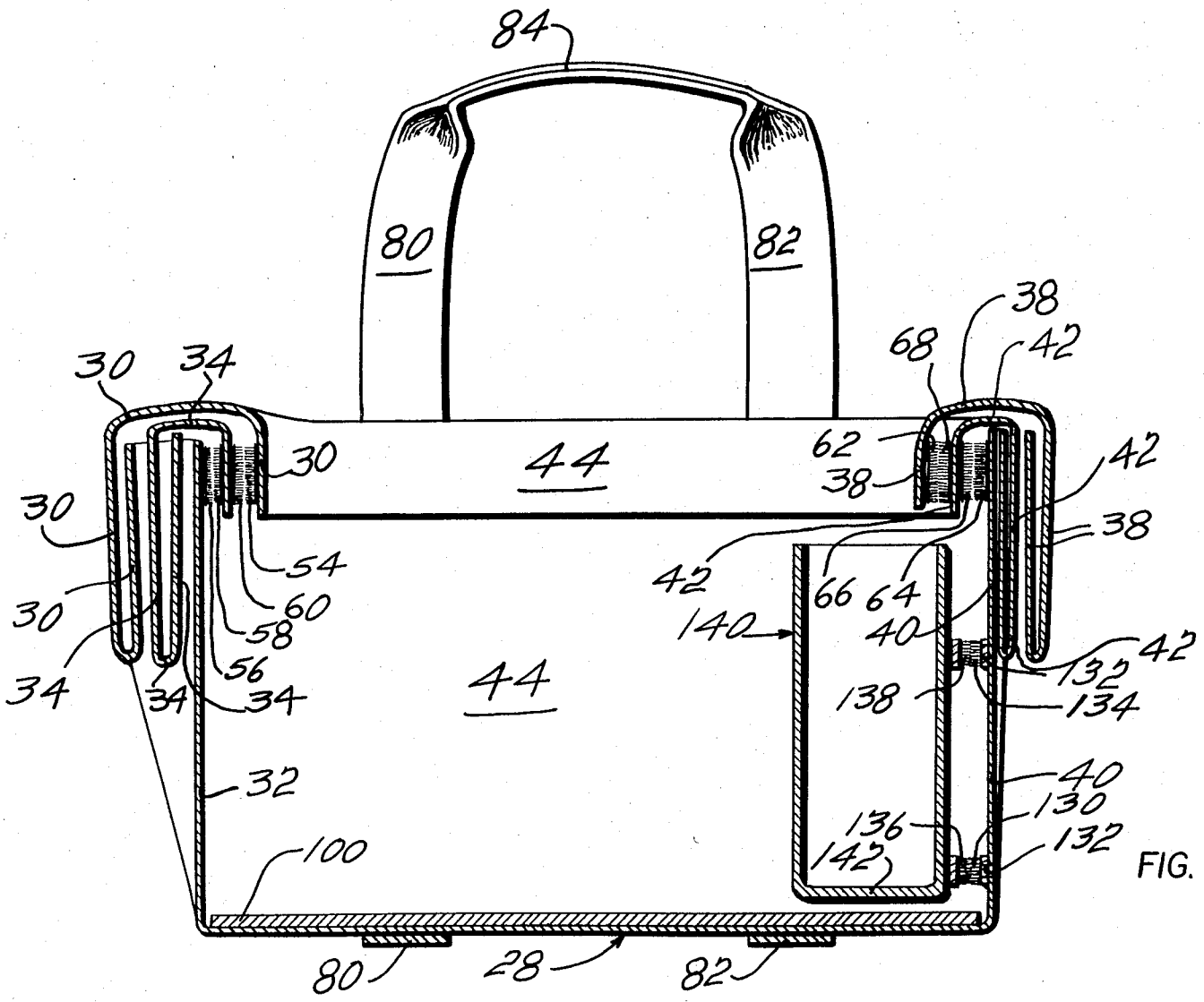
Figure 17:
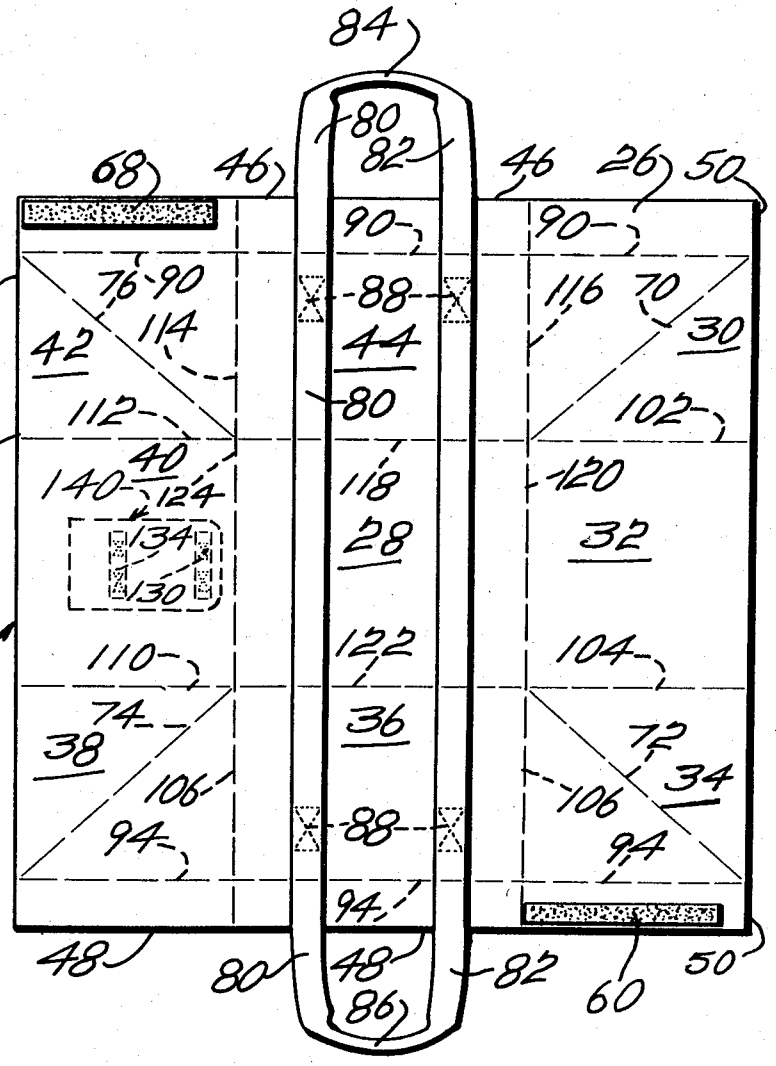
Figure 16:
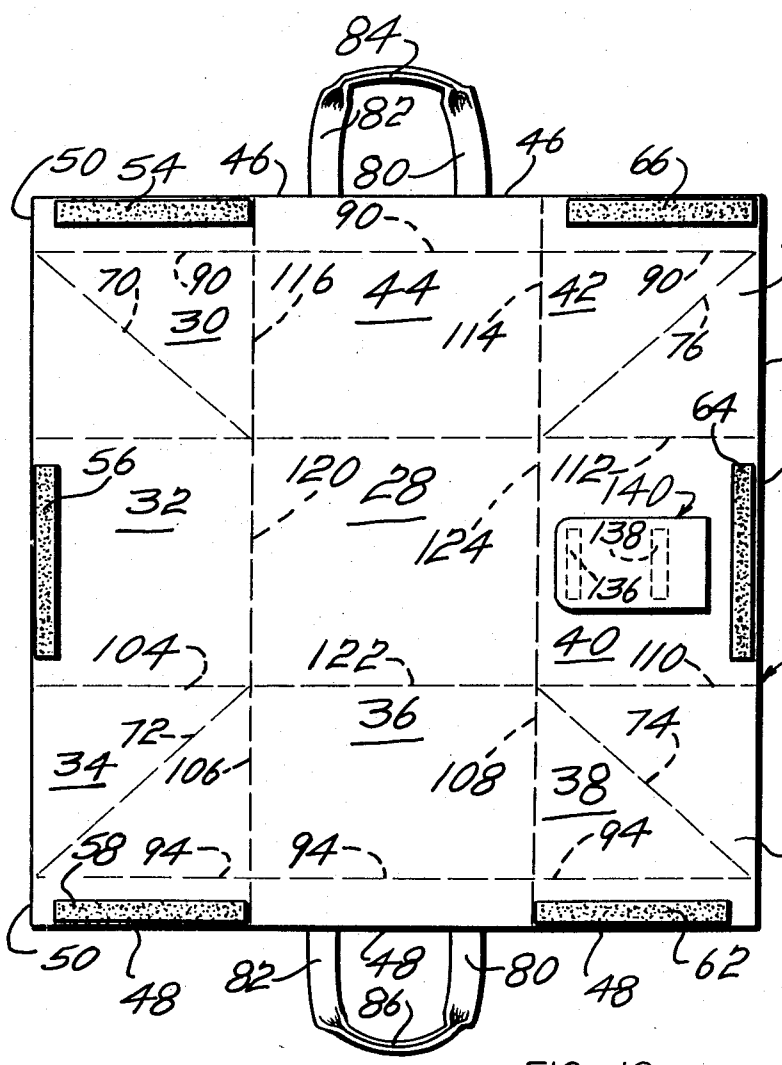

FIG. 12, on an enlarged scale, illustrates one form of an attaching means comprising loops and flexible hooks;

FIG. 13 is a top plan view of the invention in the configuration of a basket and illustrates a container for holding a thermos, a bottle of wine or another similar object;

FIG. 14 is a bottom plan view of the invention in the configuration of a basket and illustrates in phantom line the container for holding the bottle of wine, a thermos or similar article;

FIG. 15 is a vertical cross-sectional view from the first end of the second end of the invention in the configuration of a basket and is similar to FIG. 5 and illustrates a container and the attaching means between the container and the second end panel of the invention;

FIG. 16 is a top plan view of the apparatus as spread out or stretched out and illustrates the container on the second end panel; and, FIG. 17 is a bottom plan view of the apparatus as spread out or stretched out and illustrates, in phantom line, the container on the second end panel.

THE SPECIFIC DESCRIPTION OF THE INVENTION

Figure 8:
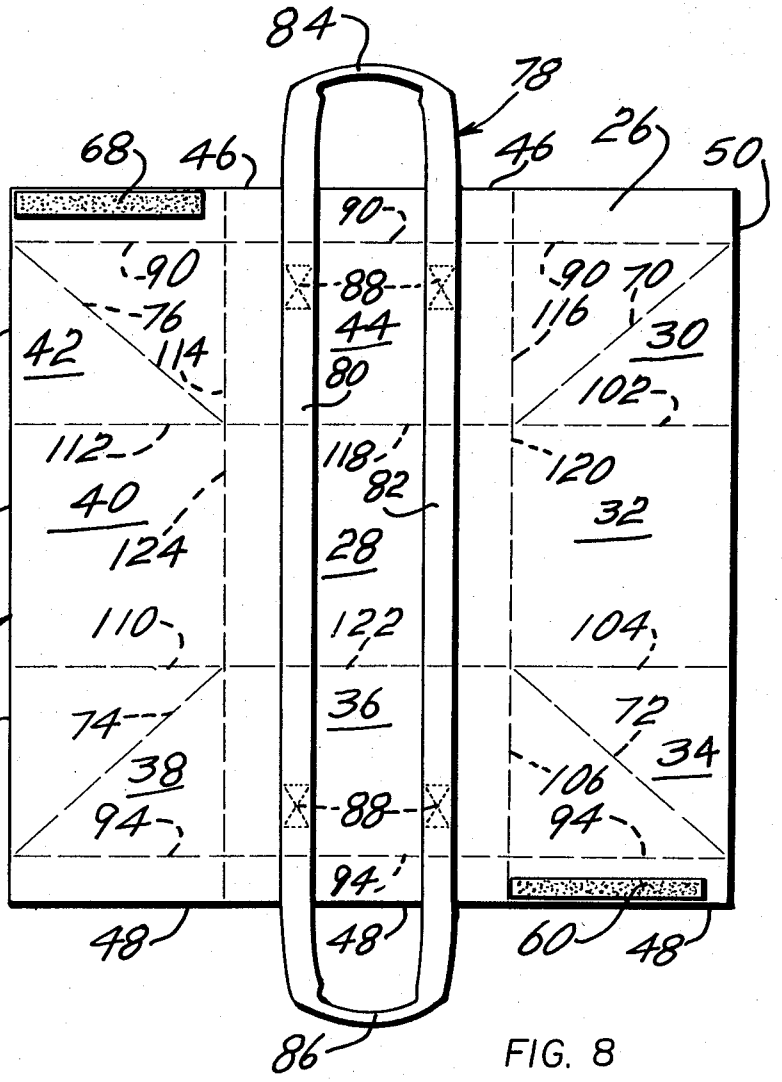
FIG. 8 is a bottom plan view of the apparatus as spread out or stretched out.
Figure 7:
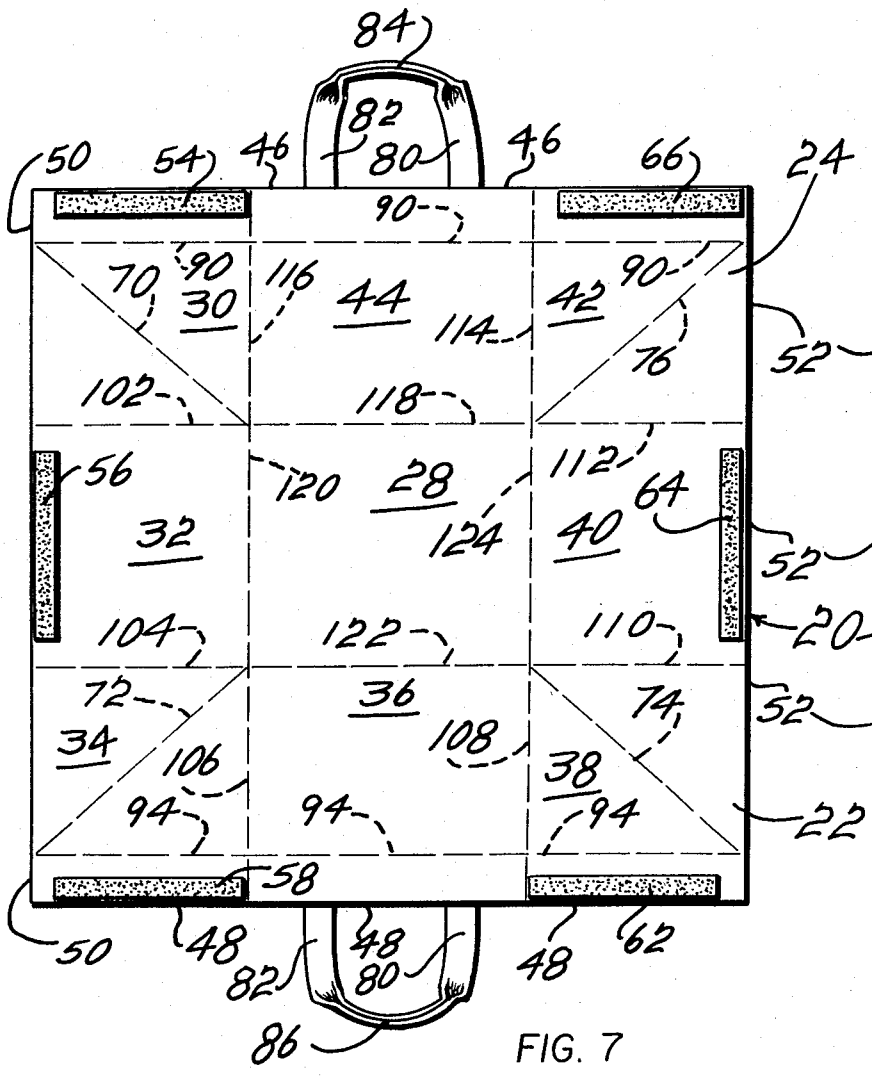
FIG. 7 is a top plan view of the apparatus as spread out or stretched out.

The reader is referred to FIGS. 7 and 8 which illustrate the invention in a spread out or stretched out state such as a tablecloth. In FIG. 7 it is seen that the invention comprises an apparatus 20 of a flexible limber material 22.

In FIG. 7 the first surface 24 is facing upwardly.

In FIG. 8 the second surface 26 is facing upwardly.

In a latter part of this description it will be seen that in the folded state or in the basket state that the first surface 24 is the inner surface and the second surface 26 is the outer surface.

In FIG. 7 it is seen that the flexible limber material 22 has been divided into nine panels. There is a central panel 28.

In FIG. 7 and to the northwest of the central panel 28 there is a first corner panel 30. To the west of the central panel 28 there is a first end panel 32. To the southwest of the central panel 28 there is a second corner panel 34.

To the south of the central panel 28 there is a second side panel 36. To the southeast of the central panel 28 there is a third corner panel 38. To the east of the central panel 28 there is a second end panel 40.

To the northeast of the central panel 28 there is a fourth corner panel 42.

To the north of the central panel 28 there is a first side panel 44.

There is a first side edge 46 and a second side edge 48. The first side edge 46 and the second side edge 48 are on opposite sides of the flexible limber material 22 and are, substantially, parallel to each other.

There is a first end 50 and a second end 52. The first end 50 and the second end 52 are on opposite ends of the flexible limber material 22 and are, substantially, parallel to each other.

In FIG. 7 it is seen that in the first corner panel 38 and near the first side edge 46 there is a first attaching means 54.

In FIG. 7 it is seen that in the first end panel 32 near the first end 50 there is a second attaching means 56.

In FIG. 7 it is seen that in the second corner panel 34 and near the second side 48 that there is a third attaching means 58.

In FIG. 7 it is seen that in the third corner panel 33 and near the second side 48 that there is a fifth attaching means 62.

In FIG. 7 and in the second end panel 40 and near the second end 52 there is a sixth attaching means 64.

In FIG. 7 it is seen that in the fourth corner panel 42 and near the first side edge 46 that there is a seventh attaching means 66.

The first attaching means 54; second attaching means 56; third attaching means 58; fifth attaching means 62; sixth attaching means 64 and seventh attaching means 66 are all on the first surface 24 of the flexible limber material 22.

In FIG. 8 it is seen that in the second corner panel 34 and near the second side edge 48 that there is a fourth attaching means 60.

In FIG. 8 it is seen that on the fourth corner panel 42 and near the first side edge 46 that there is an eighth attaching means 68.

The fourth attaching means 60 and the eighth attaching means 68 are on the second surface 26 of the flexible limber material 22.

With respect to FIG. 7 it is seen that in the first corner panel 30 and running from the northwest corner of the central panel 28 to the upper part of the first end 50 that there is a first diagonal fold line 70. In the second corner panel 34 and running from the southwest corner of the central panel 28 and to almost the free end of the first end 50 there is a second diagonal fold line 72. In the third corner panel 38 and running from the southeast corner of the central panel 28 and almost to the free end of the second end 52 there is a third diagonal fold line 74.

In the fourth corner panel 42 and running from the northeast corner of the central panel 28 and almost to the free end of the second end 52 there is fourth diagonal fold line 76.

In FIG. 8 there is illustrated a carrying means 78 which is attached to the second surface 26. The carrying means 78 comprises a first base 80 and a second base 82. There is a first loop 84 connecting 80 and 82. There is a second loop 86 connecting 82 and 80. The bases 80 and 82 can be attached to the flexible limber material 22 by stitching 88.

In FIG. 7 it is seen that inset from the first side 46 that there is a fold line 90. The outer edge of the first side 46 is folded over the first surface 24.

Also, in FIG. 7 it is seen that there is the first end 50. The outer edge near the first end 50 is folded over the first surface 24.

Further, in FIG. 7 it is seen that near the second side 48 that there is fold line 94. The outer part of the material 22 near the second side 48 is folded inwardly over the first surface 24.

Also, in FIG. 7 it is seen that there is the second end 52. The outer part of the material 22 near the second end 52 is folded over the first surface 24.

In making the basket from the apparatus 20 as illustrated in FIGS. 7 and 8 requires the folding of panels so that all of the panels are positioned more or less normal to the central panel 28.

In forming the basket as illustrated in FIGS. 1 through 6 it is necessary to fold the panels with respect to each other.

The attention of the reader is directed to FIGS. 5, 6, 7 and 8.

The second corner panel 34 is folded along the second diagonal fold line 72 to overlap the first end panel 32. The second side 48 of the second corner panel 34 is folded over the first end 50 of the end panel 32 so that the third attaching means connects with the second attaching means. In this regard see FIG. 5. In this position the fourth attaching means 60 is directed inwardly and toward the central panel 28. Then, the first corner panel 30 is folded along the first diagonal fold line so as to overlap the second corner panel 34 and the first end panel 32. The first attaching means 54 is connected to the fourth attaching means 60. With this arrangement the first corner of panel 30 and the second corner panel 34 as well as the first end panel 32 are substantially perpendicular to the central panel 28. That part of the second corner of panel 32 near the second side 48 overlies the first end of the first end panel 32. Also, that part of the first side of the first corner panel 30 overlies that part of the second side 48 of the second corner panel 32 and also overlies that part of the first end 50 of the first end panel 32. This is illustrated in FIG. 5.

The folding of the third corner panel 38, second end panel 40 and fourth corner panel 42 is performed in a manner similar to the folding of the first corner panel 30, the first end panel 32 and the second corner panel 34. The fourth corner panel 42 is folded along the fourth diagonal fold line 76 so that the panel 42 is on the outside of the second end panel 40 but with that part near the first side 46 passing over the second end 52 of the second end panel 40. The seventh attaching means 66 connects with the sixth attaching means 64. This places the eighth attaching means 68 facing in a direction toward the central panel 28. Then, the third corner panel 38 is folded along the third diagonal fold line 74 and over the second end edge 52 of the second end panel 40 and also over the fourth corner panel 42 with the fifth attaching means 62 connecting with the eighth attaching means 68. In FIG. 5 it is seen that the third corner panel 38, the second end panel 40 and the fourth corner panel 42 are substantially perpendicular to the central panel 28. Also, it is seen that that part of the first side of the fourth corner panel 40 overlies the second end 52 of the second end panel 40. Further, that part of the second side 48 of the third corner of panel 48 passes over that part of the first side 46 of the fourth corner panel 42 and also passes over that part of the second end 52 of the second end panel 40.

With the first corner panel 40, the first end panel 32, the second corner of panel 34, the third corner of panel 38, the second end panel 40 and the fourth corner of panel 42 being substantially perpendicular to the central panel 28 the first side panel 44 and the second side panel 36 are also substantially perpendicular to the central panel 28. The result is a basket for carrying objects such as food and drink for a picnic or an outing.

The loops 84 and 86 make it possible to carry the apparatus 20 in the basket form and with the food and drink in the apparatus.

In addition to using the apparatus 20 in a basket form for carrying food and drink it is also possible to carry other items such as notebooks, books, newspapers and the like to name a few other items.

After the individual or individuals have made the apparatus 20 into a basket for carrying food and drink it is possible to take the food and drink out of the basket and to disconnect the attaching means from each other and to spread out the apparatus 20 as illustrated in FIG. 7 so as to have a table cloth or a picnic cloth on which to place the food and drink.

With the apparatus 20 in a basket form it is seen that the first surface 24 is the inner surface and the second surface 26 is the outer surface.

To add stiffness to the apparatus 20 there can be placed over the central panel 28 or under the central panel 28 a stiff reenforcing sheet 100 such as fiberboard. With the fiberboard juxtapositioned to the panel 28 the basket has more rigidity in the central area and makes it easier to carry food and drink in the basket.

The flexible limber material 22 may be one piece of material having a first surface 24 and a second surface 26. Also, the flexible limber material 22 may be two pieces of material with an outer material which is wear-resistant and abrasion-resistant and an inner material which has a pleasing and pleasant design and can function as an attractive tablecloth.

In FIG. 7 it is seen that there is a fold line 102 between the first corner panel 30 and the first end panel 32.

There is a fold line 104 between the first end panel 32 and the second corner panel 34.

There is a fold line 106 between the second corner panel 34 and the second side panel 36.

There is a fold line 108 between the second side panel 36 and the third corner panel 38.

There is a fold line 110 between the third corner panel 38 and the second end panel 40.

There is a fold line 112 between the second end panel 40 and the fourth corner panel 42.

There is a fold line 114 between the fourth corner panel 42 and the first side panel 44.

There is a fold line 118 between the first side panel 44 and the central panel 28.

There is a fold line 120 before the first end panel 42 and the central panel 28.

There is a fold line 122 between the central panel 28 and the second side panel 36.

There is a fold line 124 between the central panel 28 and the second end panel 40.

In FIGS. 13 through 17 there is illustrated a modification for the invention. This modification comprises a container 140 having a bottom 142 and an upright, generally, circular wall 144. The container 140 can be in the general configuration of a right circular cylinder. The container 140 can be of a flexible, resilient limber material such as cloth or canvas. The container 140 can be for holding a thermos, a bottle of wine, or other appropriate subject matter.

On the inner surface of the second end panel 40 and near the lower end there is lower first attaching means 130. On the inner surface of the second end panel 40 and positioned slightly above mid-way there is an upper first attaching means 134. The attaching means 130 and 134 can be attached to the inside surface of the second end panel 40 by means of stitching 132 or an appropriate adhesive or by both. On the outside surface, near the lower end of the container 140 there is a lower second attaching means 136 which co-acts with the lower first attaching means 130 to attach the lower part of the container to the second end panel 40. On the upper part of the container 140, on the outside surface, there is an upper second attaching means 138. The attaching means 138 co-acts with the upper first attaching means 134 to attach the upper part of the container 140 to the second end panel 40. The attaching means 136 and 138 can be attached to the container 140 by means of stitching and/or an appropriate adhesive.

The attaching means 130 and 136 are releasably connected and the attaching means 134 and 138 are releasably connected. It is possible to definitely position the container 140 on the inside surface of the second end panel by means of the appropriate attaching means. If it is desired to not have the container 140 attached to the second end panel 40 the attaching means can be separated and the container 140 removed.

In FIG. 13 there is a top plan view of the invention in the configuration of a basket showing the container and the attaching means for attaching the containter to the second end panel.

In FIG. 14 there is a bottom plan view of the invention in the configuration of a basket and illustrates in phantom the container and the attaching means for attaching the container to the inside surface of the second end panel.

In FIG. 16 there is a plan view of the invention in a flat or stretched out state and illustrates the container in phantom the attaching means for attaching the container to the inside surface of the second end panel.

In FIG. 17 there is a bottom plan view of the invention in a flat or stretched out state and illustrates in phantom the container and the attaching means for attaching the container to the inside surface of the second panel.

The attaching means such as the first, second, third, fourth, fifth, sixth, seventh and eighth attaching means can be of the type illustrated and described in the following U.S. Pat. Nos. 3,387,345; 3,192,589; 3,154,837; 3,147,528; 3,130,111; 3,076,244; 3,009,235; 3,000,384; 2,717,437. These are only a few of the patents of the general type of attaching means which can be used. A more complete list of this type of patents can be found by reading the "References Cited" in these patents. These attaching means comprise a base 150 with loops 152, and a base 154 with hooks 156. The loops and hooks are, usually of plastic.

The lower first attaching means 130, upper first attaching means 134, lower second attaching means 136 and upper second attaching means 138 can also be of this class of attaching means.

The attaching means 130, 134, 136, and 138 can be a bottom and a bottom-hole or can be snaps.

In preparing this patent application I did not make a patent search.

It is seen from the foregoing that the invention can serve a double purpose. The invention can be used as a basket for carrying food on a picnic and also can be used as a tablecloth when spread on a table or the ground at a picnic. Further, although the invention was not meant for this purpose, the invention in the basket form can be used for carrying books, paper tablets, notes for a patent application and the like.

The invention is light in weight and for its weight can be used for carrying quite a heavy load. The invention can be used for carrying a load of about twenty pounds. The invention as used as a basket is used for carrying various items. Also, as a basket the invention can be used as a storage unit for small items.

When the invention is not in use, it can be spread and stored. For example, the invention when not in use can be spread and hung as a sheet of material or formed into a roll and stored as a roll or folded into a neat pack. In all of these configurations the invention will not take up a great volume. Due to its versatility in storage the invention can be stored in many places either hung as a sheet of material or rolled into a cylinder and stored or folded into a neat pack and stored.

I consider this invention to be new and unobvious. I have never seen another object like this invention. I have manufactured cloth articles for a number of years, and still manufacture cloth articles, and have never seen an invention like this one. To repeat, in preparing this patent application, a patent search was not conducted.

I consider this invention to be useful as it can be used as a carrying case for carrying food and drink on a picnic, can be used as a tablecloth at a picnic, and also can be used, in the basket configuration, for carrying books, tablets, paper and the like. I assume that in the basket configuration it can also be used for carrying clothes such as athletic clothes and also shoes such as tennis shoes, tennis balls and the like.

What I claim is:

1. An apparatus comprising:
a. a flexible, limber material;
b. said material having a first surface and a second surface;
c. said material having a first side and a second side;
d. said first side and said second side being, substantially, parallel;
e. said material having a first end and a second end;
f. said first end and said second end being, substantially parallel;
g. said material may be considered as comprising nine panels;
h. said nine panels being a central panel, a first side panel, a first corner panel, a first end panel, a second corner panel, a second side panel, a third corner panel, a second end panel and a fourth corner panel;
i. said first end panel bordering said central panel;
j. said first end panel being between and bordering said first corner panel and said second corner panel;
k. said second side panel bordering said central panel;
l. said second side panel being positioned between said second corner panel and said third corner panel;
m. said second end panel bordering said central panel;
n. said second end panel being positioned between said third corner panel and said fourth corner panel;
o. said first side panel bordering said central panel;
p. said first side panel being positioned between said first corner panel and said fourth corner panel;
q. a first attaching means on the first surface of the first corner panel and near the first side;
r. a second attaching means on the first surface of the first end panel and near the first end;
s. a third attaching means on the first surface of the second corner panel and near the second side;
t. a fourth attaching means on the second surface of the second corner panel and near the second side;
u. a fifth attaching means on the first surface of said third corner panel near the second edge;
v. a sixth attaching means on the first surface of the second end panel and near the second end;
w. a seventh attaching means on the first side of the fourth corner panel and near the first side; and,
x. an eighth attaching means on the second side of the fourth corner panel and near the first side.

2. An apparatus according to claim 1 and comprising:
y. a carrying means for said apparatus.

3. An apparatus according to claim 1 and comprising:
y. said material being unitary.

4. An apparatus according to claim 1 and comprising:
y. said material and said attaching means being integral.

5. An apparatus according to claim 1 and comprising:
y. a stiff reinforcing sheet juxtapositioned to said central panel.

6. An apparatus according to claim 1 and comprising:
y. a carrying means for said apparatus;
z. said material, said attaching means and said carrying means being integral; and,
aa. a stiff reinforcing sheet juxtapositioned to said central panel.

7. An apparatus according to claim 1 and comprising:
y. said first end panel being positioned approximately perpendicular to said central panel;
z. said second side panel being positioned approximately perpendicular to said central panel;
aa. said second corner panel being positioned on the outside of said second surface of said first end panel with the outer part of said second corner panel adjacent to said second side folded over said first end adjacent to said first end panel and with said third attaching means operatively connecting with said second attaching means;
bb. said first corner panel being positioned on the outside of said second surface of said first end panel and on the outside of said second surface of said second corner panel with the outer part of said first corner panel adjacent to said first side folded over said first end adjacent to said first end panel and folded over the outer part of said second corner panel juxtapositioned to said second edge and with said first attaching means operatively connecting with said fourth attaching means;
cc. said first side panel being positioned approximately perpendicular to said central panel;
dd. said second end panel being positioned approximately perpendicular to said central panel;
ee. said fourth corner panel being positioned on the outside of said second surface of said second end panel with the outer part of said fourth corner panel and adjacent to said first side folded over said second end adjacent to said second end panel and with said seventh attaching means operatively connecting with said sixth attaching means;
ff. said third corner panel being positioned on the outside of said second surface of said second end panel and on the outside of said second surface of said fourth corner panel adjacent to said second side folded over said second end adjacent to said second end panel and folded over the outer part of said fourth corner panel juxtapositioned to said first edge and with said fifth attaching means operatively connecting with said eighth attaching means; and,
gg. said first surface being an interior surface and said second surface being an exterior surface.

8. An apparatus according to claim 7 and comprising:
hh. a carrying means for said apparatus.

9. An apparatus according to claim 7 and comprising:

hh. said material being unitary.

10. An apparatus according to claim 7 and comprising:

hh. said material and said attaching means being integral.

11. An apparatus according to claim 7 and comprising:

hh. a stiff reinforcing sheet juxtapositioned to said central panel.

12. An apparatus according to claim 7 and comprising:

hh. a carrying means for said apparatus;

ii. said material, said attaching means and said carrying means being integral;

jj. a stiff reinforcing sheet juxtapositioned to said central panel; and, kk. said carrying means comprising an enclosure for ease of handling said carrying means and said apparatus.

13. An apparatus according to claim 1 and comprising:

y. a pouch operatively connecting with said material and for holding an object.

14. An apparatus according to claim 7 and comprising:

hh. a pouch operatively connecting with said material and for holding an object.

15. An apparatus comprising:

a. a flexible, limber material;

b. said material having a first surface and a second surface;

c. said material having a first side and a second side;

d. said first side and said second side being, substantially, parallel;

e. said material having a first end and a second end;

f. said first end and said second end being, substantially parallel;

g. said material may be considered as comprising nine panels;

h. said nine panels being a central panel, a first side panel, a first corner panel, a first end panel, a second corner panel, a second side panel, a third corner panel, a second end panel and a fourth corner panel;

i. said first end panel bordering said central panel;

j. said first end panel being between and bordering said first corner panel and said second corner panel;

k. said second side panel bordering said central panel;

l. said second side panel being positioned between said second corner panel and said third corner panel;

m. said second end panel bordering said central panel;

n. said second end panel being positioned between said third corner panel and said fourth corner panel;

o. said first side panel bordering said central panel;

p. said first side panel being positioned between said first corner panel and said fourth corner panel;

q. attaching means for operatively connecting together said first corner panel, said first end panel and said second corner panel; and, r. attaching means for operatively connecting together said third corner panel, said second end panel and said fourth corner panel.

16. An apparatus according to claim 15 and comprising:

s. with said first corner panel and said first end panel and said second corner panel operatively connecting together by said attaching means said first corner panel and said first end panel and said second corner panel overlap each other and are, approximately, perpendicular to said central panel; and, t. with said third corner panel and said second end panel and said fourth corner panel operatively connecting by said attaching means said third corner panel and said second end panel and said fourth corner panel overlap each other and are, approximately, perpendicular to said central panel.

17. An apparatus according to claim 16 and comprising:

u. said first surface being an interior surface said second surface being an exterior surface.

18. An apparatus according to claim 16 and comprising:

u. a carrying means for said apparatus.

19. An apparatus according to claim 16 and comprising:

u. said material being unitary.

20. An apparatus according to claim 16 and comprising:

u. said material and said attaching means being integral.

21. An apparatus according to claim 16 and comprising:

u. a stiff reinforcing sheet juxtapositioned to said central panel.

22. An apparatus according to claim 16 and comprising:

u. said first surface being an interior surface said second surface being an exterior surface;

v. a carrying means for said apparatus;

w. said material, said attaching means and said carrying means being integral; and, x. a stiff reinforcing sheet juxtapositioned to said central panel.

23. An apparatus according to claim 22 and comprising:

y. a pouch operatively connecting with said material and for holding an object.

24. A method for making an apparatus for carrying objects and also for spreading on a support for receiving objects, said method comprising:

a. selecting a flexible material;

b. said material having a first surface and a second surface;

c. designating a first side and a second side for said material;

d. designating a first end and a second end for said material;

e. designating nine panels for said material;

f. said nine panels being a central panel, a first side panel, a first corner panel, a first end panel, a second corner panel, a second side panel, a third corner panel, a second end panel and a fourth corner panel;

g. said first end panel bordering said central panel;

h. said first end panel being between and bordering said first corner panel and said second corner panel;

i. said second side panel bordering said central panel;

j. said second side panel being positioned between said second corner panel and said third corner panel;

k. said second end panel bordering said central panel;

l. said second end panel being positioned between said third corner panel and said fourth corner panel;

m. said first side panel bordering said central panel;

n. said first side panel being positioned between said first corner panel and said fourth corner panel;

o. positioning attaching means on said first corner panel, said first end panel and said second corner panel for operatively connecting together said first corner panel, said first end panel and said second corner panel; and, p. positioning attaching means on said third corner panel, said second end panel and said fourth corner panel for operatively connecting together said third corner panel and said second end panel and said fourth corner panel.

25. A method for making an apparatus according to claim 24 and comprising:

q. operatively connecting together said third corner panel and said second end panel and said fourth corner panel to have said panels overlap each other and to be, approximately, perpendicular to said central panel;

r. operatively connecting together said first corner panel and said first end panel and said second corner panel to have said panels overlap each other and to be, approximately perpendicular to said central panel;

s. positioning all of said panels, except said central panel, approximately perpendicular to said central panel to have said apparatus in the configuration of a bag for carryiing said objects.

26. A method for making an apparatus according to claim 24 and comprising:

q. positioning a carrying means on said apparatus to when in the configuration of a bag.

27. A method for making an apparatus according to claim 24 and comprising:

q. positioning a stiff reinforcing sheet on said central panel.

28. A method for making an apparatus according to claim 24 and comprising:

q. positioning a pouch, for holding an object, on said material.

29. A method for making an apparatus according to claim 24 and comprising:

q. operatively connecting together said third corner panel and said second end panel and said fourth corner panel to have said panels overlap each other and to be, approximately, perpendicular to said central panel;

r. positioning a carrying means on said apparatus to when in the configuration of a bag;

s. positioning a stiff reinforcing sheet on said central panel.

30. A method for making an apparatus according to claim 24 and comprising:

q. in positioning said attaching means positioning a first attaching means on the first surface of the first corner panel and near the first side;

r. in positioning said attaching means positioning a second attaching means on the first surface of the first end panel and near the first end;

s. in positioning said attaching means positioning a third attaching means on the first surface of the second corner panel and near the second side;

t. in positioning said attaching means positioning a fourth attaching means on the second surface of the second corner panel and near the second side;

u. in positioning said attaching means positioning a fifth attaching means on the first surface of said third corner panel near the second edge;

v. in positioning said attaching means positioning a sixth attaching means on the first surface of the second end panel and near the second end;

w. in positioning said attaching means positioning a seventh attaching means on the first side of the fourth corner panel and near the first side;

x. in positioning said attaching means positioning an eighth attaching means on the second side of the fourth corner panel and near the first side;

v. positioning said first end panel approximately perpendicular to said central panel;

z. positioning said second side panel approximately perpendicular to said central panel;

aa. positioning said second corner panel on the outside of said second surface said second corner panel being positioned on the outside of said second surface of said first end panel with the outer part of said second corner panel adjacent to said second side folded over said first end adjacent to said first end panel and with said third attaching means operatively connecting with said second attaching means;

bb. positioning said first corner panel on the outside of said second surface of said first end panel said first corner panel being positioned on the outside of said second surface of said first end panel and on the outside of said second surface of said second corner panel with the outer part of said first corner panel adjacent to said first side folded over said first end adjacent to said first end panel and folded over the outer part of said second corner panel juxtapositioned to said second edge and with said first attaching means operatively connecting with said fourth attaching means;

cc. positioning said first side panel approximately perpendicular to said central panel;

dd. positioning said second end panel approximately perpendicular to said central panel;

ee. positioning said fourth corner panel on the outside of said second surface of said second end panel said fourth corner panel being positioned on the outside of said second surface of said second end panel with the outer part of said fourth corner panel and adjacent to said first side folded over said second end adjacent to said second end panel and with said seventh attaching means operatively connecting with said sixth attaching means;

ff. positioning said third corner panel on the outside of said second surface of said second end panel said third corner panel being positioned on the outside of said second surface of said second end panel and on the outside of said second surface of said fourth corner panel adjacent to said second side folded over said second end adjacent to said second end panel and folded over the outer part of said fourth corner panel juxtapositioned to said first edge and with said fifth attaching means operatively connecting with said eighth attaching means; and, qq. in so positioning said attaching means said first surface being an interior surface and said second surface being an exterior surface.

* * * * *